United States Patent [19]

Shikata

[11] 4,399,776

[45] Aug. 23, 1983

[54] SYSTEM FOR CONTROLLING COOLING WATER TEMPERATURE FOR A WATER-COOLED ENGINE

[75] Inventor: Makoto Shikata, Musashimurayama, Japan

[73] Assignee: Fuji Jukogyo Kabushiki Kaisha, Tokyo, Japan

[21] Appl. No.: 371,760

[22] Filed: Apr. 26, 1982

[30] Foreign Application Priority Data

May 1, 1981 [JP] Japan ..... 56-67223

[51] Int. Cl.[3] ..... F01P 7/14

[52] U.S. Cl. ..... 123/41.08; 123/41.44; 236/34.5

[58] Field of Search ..... 237/12.3 B; 236/34, 236/34.5; 165/40; 123/41.02, 41.08, 41.44

[56] References Cited

U.S. PATENT DOCUMENTS

| | | | |
|---|---|---|---|
| 1,500,418 | 7/1924 | Page et al. | 123/41.08 |
| 2,134,662 | 10/1938 | Flamm | 123/41.08 |
| 3,851,629 | 12/1974 | Mayr et al. | 236/34.5 X |
| 3,921,600 | 11/1975 | Henning et al. | 236/34.5 X |
| 3,939,807 | 2/1976 | Eichinger | 123/41.08 |
| 4,337,733 | 7/1982 | Hirata et al. | 123/41.1 |

*Primary Examiner*—William E. Tapolcai

*Attorney, Agent, or Firm*—Martin A. Farber

[57] ABSTRACT

A system for controlling cooling water temperature for a water-cooled engine has an intake passage, a radiator, a water jacket provided in the engine for cooling the engine, a water passage for communicating the water jacket with the radiator, a thermostat provided in the water passage, the thermostat being so arranged as to open the water passage when the water temperature exceeds a predetermined value, and a pump causing the cooling water in the water jacket to flow. There is provided a bypass connected between the outlet of the water jacket and the inlet of the pump, and a circulation pipe connected between the outlet and inlet of the pump. A solenoid valve is provided for selectively connecting the water passage and circulation pipe with the inlet of the pump and a flow control valve is provided in the water passage for controlling flow rate of water. The solenoid valve operates, when water temperature is higher than a predetermined value, so that the bypass is communicated with the inlet of the pump thereby to cause the water in the water jacket to flow passing through the bypass. The flow control valve is operated in dependency on the engine speed and the load on the engine for the controlling the water temperature at a water temperature higher than the above mentioned predetermined value.

2 Claims, 2 Drawing Figures

SYSTEM FOR CONTROLLING COOLING WATER TEMPERATURE FOR A WATER-COOLED ENGINE

BACKGROUND OF THE INVENTION

The present invention relates to a system for controlling cooling water temperature for a water-cooled engine mounted on an automotive vehicle, and more particularly to a system which controls the cooling water temperature to a proper temperature according to conditions of engine temperature and engine operation.

In a conventional cooling water control system, a water pump is driven by the engine, so that flow rate of the cooling water is varied by the engine speed. Further, the flow rate of the cooling water is controlled by a thermostat which is provided in a cooling water conduit pipe connected to a radiator and is adapted to be opened when the cooling water temperature exceeds a predetermined temperature to permit the cooling water to flow to the radiator. Thus, temperature of the cooling water is controlled by the control of flow rate. Therefore, the cooling water temperature is not controlled in accordance with conditions of the engine temperature and engine operation. Accordingly, the cooling water is not kept to a proper temperature.

The flow rate in the cooling system of a conventional system is decided so as to satisfy the operation of the engine in full-load conditions such as uphill driving with the full open throttle operation. Accordingly, the flow rate preferably set for such a full-load condition is excessively high for an operation at a slow speed or a partial load. Although the cooling water temperature at low speed is also controlled by the thermostat, combustion chambers and cylinders wall of the engine is over cooled, because the water velocity is high. This causes decrease of thermal efficiency of the engine.

In order to eliminate such disadvantages, it is necessary to control finely the flow rate of the cooling water. Japanese patent application layed open No. 50-25951 discloses a control system which is intended to meet such a requirement. However, the system does not satisfy the warming up in cold engine operation and the cooling water temperature is not controlled according to engine operation.

SUMMARY OF THE INVENTION

An object of the present invention is to provide a system which controls the cooling water temperature according to engine operation for preventing decrease of the thermal efficiency at slow speed and partial load. Another object of the present invention is to provide a cooling water system which is capable of a rapid warm up in cold engine.

According to the present invention, there is provided a system for controlling cooling water temperature of a water-cooled engine having an intake passage, a radiator, a water jacket provided in the engine for cooling the engine, a water passage for communicating the water jacket with the radiator, a thermostat provided in the water passage, the thermostat being so arranged as to open water passage when the water temperature exceeds a predetermined value, and a pump causing the cooling water in the water jacket and the water passage, etc. to flow. The system has a bypass connected between the outlet of the water jacket and the inlet of the pump; a circulation pipe connected between the outlet and inlet of the pump; a changeover valve provided for selectively connecting the water passage and circulation pipe with the inlet of the pump; a first actuator means for actuating the changeover valve; a flow control valve means provided in the water passage for controlling the flow rate of the water; a second actuator means for actuating the flow control valve; a thermoswitch means provided on the engine for operating the first actuator of the solenoid valve for communicating the bypass with the inlet of the pump at a predetermined water temperature; means for detecting engine operation and for operating the second actuator of the flow control valve for controlling the flow rate of water at higher than the predetermined water temperature.

The other objects and features are explained more in detail with reference to the accompanying drawings.

DETAILED DESCRIPTION OF THE PREFERRED EMBODIMENTS

Figure 1:
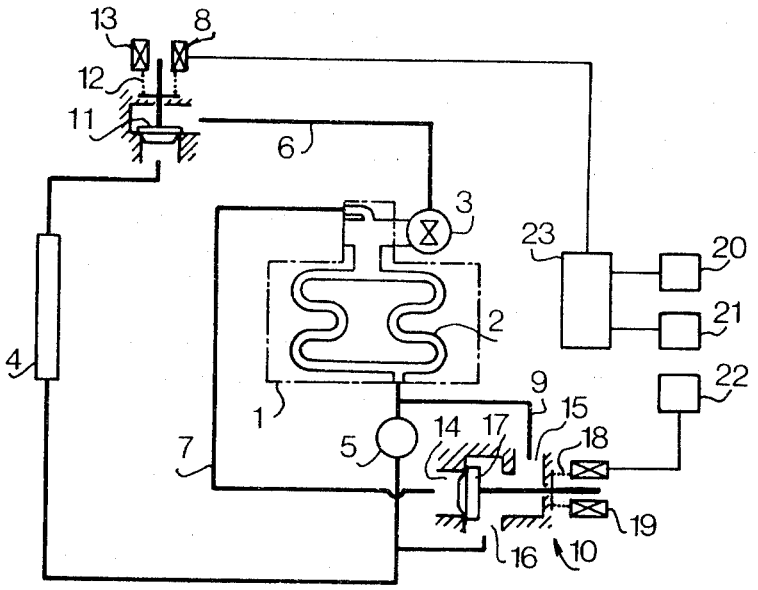
FIG. 1 is a schematic diagram showing a system according to the present invention.

Referring to FIG. 1, an engine 1 has a water jacket 2 which has a thermostat 3 at an outlet portion, and a pump 5 at the inlet portion. The outlet of the thermostat 3 is communicated with a radiator 4 through an water passage 6 and a flow control valve 8. The outlet of the radiator is connected to the inlet of the pump 5. A bypass 7 is connected between the other outlet of the water jacket 2 and an inlet port 14 of a changeover valve 10. The outlet of the pump 5 is communicated with its own inlet by a circulation pipe 9 through another inlet port 15 and outlet port 16 of the changeover valve 10. The changeover valve 10 has a valve body 17 for closing the ports 14 or 15. The valve body 17 is biased by a spring 18 to close the port 14 and is drawn by exciting a coil 19 thereby to open the port 14 and close the port 15.

Figure 2:
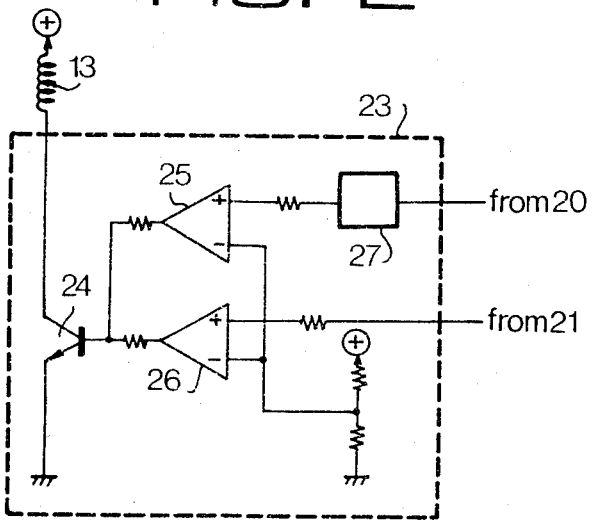
FIG. 2 is a circuit showing a control circuit used in the system of FIG. 1.

The flow control valve 8 is provided with a valve body 11 having a frustrum shape. The valve body 11 is urged by a spring 12 to close a valve port and is drawn by energizing a coil 13 to open the port. The opening rate of the valve body 11 is determined by a voltage applied to the coil 13. The coil 13 is electrically connected to a control circuit 23. As shown in FIG. 2, the control circuit 23 comprises a transistor 24 for switching the coil 13, a digital-analogue converter 27 and operational amplifiers 25 and 26. Accordingly, sum of outputs of amplifiers 25 and 26 is applied to the base of the transistor 24. The operational amplifier 25 is applied with a voltage from an engine speed sensor 20.

The engine speed sensor 20, for example, comprises a ring gear mounted on a crankshaft of the engine and a pickup adjacent the ring gear for producing pulses dependent on the engine speed or comprises a circuit for generating pulses according to ignition pulses. The control circuit 23 is provided with the digital-to-analogue converter 27 electrically connected to the output of the engine speed sensor 20. Thus, analogue voltage dependent on the output of the speed sensor 20 is applied to the operational amplifier 25.

The operational amplifier 26 is applied with a voltage from a load sensor 21, which comprises a potentiometer-type transducer operated by vacuum in the intake passage of the engine. The vacuum varies with the variation of the load on the engine.

The coil 19 is connected to an output of a thermo-switch 22 for detecting an engine temperature. The thermo-switch is provided at a position of the engine body which is liable to be excessively heated and is adapted to be closed at a temperature lower than a set temperature of the thermostat 3. The thermostat 3 is adapted to open when the water temperature exceeds the set temperature.

In cold engine operation, the thermo-switch 22 is off, so that the port 14 is closed to shut off the bypass 7. At such a low temperature, the thermostat 3 is also closed. Therefore, water circulates passing through the circulation pipe 9, ports 15 and 16. Thus, the water does not flow passing through the water jacket 2 in the engine, and warming up of the engine can be expedited. In such a cold engine operation, since the water in the jacket 2 does not flow, there may occur a local overheat in the engine. However, temperature elevation is detected by turning on of the thermo-switch 22.

When the thermo-switch 22 is turned on, the coil 19 is excited to draw the valve body 17, so that the port 14 is opened and port 15 is closed. Thus, the water in the water jacket 2 circulates through the bypass 7 thereby to control the water temperature.

When the water temperature exceeds the set temperature of the thermostat 3, the valve in the thermostat is opened. If the engine is driven at a low speed and light load, the outputs of the engine speed sensor 20 and load sensor 21 are at low values. Accordingly, the output of the control circuit 23 is at a low level, so that the valve body 11 is slightly elevated. Thus, the flow of the cooling water through the radiator 4 is regulated to a low flow rate. The elevation of the valve body 11 increases with increase of the engine speed and load on the engine, resulting in increase of cooling effect. Thus, overheat owing to high speed and heavy load operation can be prevented.

Although a single flow control valve 8 is provided in the illustrated system, a plurality of control valves may be provided to be selectively operated in dependency on outputs of sensors 20 and 21, or to be independently operated by corresponding sensor, respectively. Further, an on-off type electromagnetic valve may be employed. The control valve 8 should be operated after the opening of the thermostat. Therefore, it is preferable to provide a switch in the circuit for operating the coil 13 and to co-operate the switch with the opening of the thermostat.

In accordance with the present invention, since the cooling water does not circulate in the engine body in cold engine operation, warming up of the engine may be expedited. Further, since flow rate of water is controlled in dependency on the engine operation, cooling losses may be decreased and thermal efficiency, output and fuel consumption may be improved.

While the presently preferred embodiment of the present invention has been shown and described, it is to be understood that this disclosure is for the purpose of illustration and that various changes and modifications may be made without departing from the spirit and scope of the invention as set forth in the appended claim.

What is claimed is:

1. In a system for controlling cooling water temperature of a water-cooled engine having an intake passage, a radiator, a water jacket having an inside water passage provided in said engine for cooling the engine, a water passage for communicating said inside water passage with said radiator, a thermostat provided in said water passage, and a pump causing the cooling water in said inside water passage to flow, said thermostat being so arranged as to open outside water passage when the water temperature exceeds a predetermined value, the improvement comprising a bypass connected between an outlet of said water jacket and an inlet of said pump;

a circulation pipe connected between said outlet and inlet of said pump;

changeover valve means provided for selectively connecting said outside water passage and said circulation pipe with said inlet;

first actuator means for actuating said changeover valve;

flow control valve means provided in said outside water passage for controlling flow rate of the water;

second actuator means for actuating said flow control valve;

thermo-switch means provided on the engine for operating said first actuator of said changeover valve for communicating said bypass with the inlet of said pump at a predetermined water temperature;

means for detecting engine operation and for operating said second actuator of said flow control valve for controlling the flow rate of water at a water temperature higher than said predetermined water temperature.

2. The system for controlling cooling water temperature of a water-cooled engine in accordance with claim 1, wherein said detecting means comprises an engine speed sensor, a load sensor, and control circuit, each of said both sensors operates to convert a detected value to an electrical quantity, and said control circuit is adapted to sum outputs of said sensors and to apply the summation to said second actuator.

* * * * *